US005408206A

United States Patent [19]

Turunen et al.

[11] Patent Number: 5,408,206

[45] Date of Patent: Apr. 18, 1995

[54] RESONATOR STRUCTURE HAVING A STRIP AND GROOVE SERVING AS TRANSMISSION LINE RESONATORS

[75] Inventors: Aimo Turunen; Heli Jantunen, both of Oulu, Finland

[73] Assignee: LK-Products Oy, Kempele, Finland

[21] Appl. No.: 58,525

[22] Filed: May 6, 1993

[30] Foreign Application Priority Data

May 8, 1992 [FI] Finland ..... 922102

[51] Int. Cl.[6] ..... H01P 1/203; H01P 7/08

[52] U.S. Cl. ..... 333/204; 333/219

[58] Field of Search ..... 333/202-205, 333/238, 246, 219

[56] References Cited

U.S. PATENT DOCUMENTS

| | | | |
|---|---|---|---|
| 4,266,206 | 5/1981 | Bedard et al. | 333/204 |
| 4,609,892 | 9/1986 | Higgins, Jr. | 333/204 |
| 4,785,271 | 11/1988 | Higgins, Jr. | 333/204 |
| 4,800,348 | 1/1989 | Rosar et al. | 333/202 |
| 4,918,050 | 4/1990 | Dworsky | 333/204 X |
| 5,160,905 | 11/1992 | Hoang | 333/204 |
| 5,331,300 | 7/1994 | Shimizu et al. | 333/204 X |

FOREIGN PATENT DOCUMENTS

| | | | |
|---|---|---|---|
| 0364931 | 4/1990 | European Pat. Off. . | |
| 0466069A3 | 3/1992 | European Pat. Off. . | |
| 119901 | 7/1984 | Japan . | |
| 0161802 | 7/1986 | Japan | 333/204 |
| 0194702 | 8/1987 | Japan . | |
| 0131601 | 6/1988 | Japan | 333/204 |
| 0190404 | 8/1988 | Japan | 333/246 |
| 0145202 | 6/1991 | Japan | 333/203 |
| 4312002 | 11/1992 | Japan | 333/204 |
| 2139427 | 11/1984 | United Kingdom . | |
| 2184608 | 6/1987 | United Kingdom . | |
| 2236432 | 4/1991 | United Kingdom . | |

OTHER PUBLICATIONS

Patent Abstract of Japan, vol. 11, No. 33 (E-476)(2480) Jan. 30, 1987, 1 page, JP-A-61 201 501.

T. Hasegawa et al., "Characteristics of Valley Microstrip Lines for Use in Multilayer MMIC's", IEEE Microwave And Guided Wave Letters, vol. 1, No. 10, Oct. 1991, New York U.S., pp. 275-277.

T. Nishikawa et al., "800 MHz band face-bonding filter using dielectric B.D.L.S.", 1986 IEEE-MTT-S International Microwave Symposium-Digest, Jun. 2-4, 1986, Baltimore, U.S., IEEE, New York, U.S., 1986, pp. 403-406.

*Primary Examiner*—Seungsook Ham

*Attorney, Agent, or Firm*—Darby & Darby

[57] ABSTRACT

The present invention relates to a resonator structure composed of two dielectric pieces. On the upper surface of a first piece (1) is provided a groove (7) extending across the entire surface and coated with an electrically conductive agent, said coating being at least in one end connected with an electrically conductive coating serving as a ground plane, so that the groove (7) forms a transmission line resonator. On the upper surface of the second piece (2) is provided a conductive strip (9) running in the middle of the surface, said strip forming a transmission line resonator. The pieces (1,2) are placed with the upper surfaces thereof against each other and attached to each other so that the groove (7) and the strip (9) are against one another in parallel, whereby the groove and the strip together form a resonator.

16 Claims, 3 Drawing Sheets

RESONATOR STRUCTURE HAVING A STRIP AND GROOVE SERVING AS TRANSMISSION LINE RESONATORS

BACKGROUND OF THE INVENTION

The present invention relates to a resonator structure, in which the resonator is provided in an insulating material with said resonators.

A resonator is known in the art in which a conductive strip is provided on an insulating material, the length of said strip being half-wave or quarter-wave, whereby both ends of the strip are grounded or only one of the ends is grounded while the other is open. The insulating material is usually a circuit board in which the surface opposite to the strip carrying surface is metallized and forms a ground plane. Also the surface to the strip around the strip can be metallized so that a narrow non-conductive area is left between the strip and the metallized surface. The structure is known as microstrip structure in the art. The strip can be placed on a separate piece away from the circuit board, such as a ceramic bit, said bit being mountable on the circuit board. An advantage of the structure lies therein that a substrate provided with high quality electrical properties can be used for the strip line base, and for the circuit board material, a material with less powerful electrical properties can be used which is easier to work and which is less costly.

When an insulating layer and a ground plane are placed on both sides of the resonator strip, a strip line resonator is in question. An aberrant strip line resonator is described in U.S. Pat. No. 4,785,271. The resonator structure therein disclosed consists of two dielectric substrates with a resonator in the middle thereof, the cross-section thereof being elliptic or rectangular. This has been so produced that on the non-conductive surface of the substrate a groove has been made by milling or otherwise in which the cross-section is an elliptical curve or a rectangle.

The intact areas remain between both ends of the groove and the edge of the substrate surface, i.e. groove, does not extend across the entire surface. The groove has been coated with a conductive layer, and at a given point of the groove a strip line on the plane surface defining the groove is connected, one end of said strip line being on the edge of the surface. Said strip line serves as the input line for the signal, Or,as the line for the output signal. When two of such substrate pieces are connected by filling the grooves with an appropriate adhesive and by placing the grooves against each other, a strip line resonator is produced in which the central conductor is not a strip line but a tube with e.g. elliptical cross-section. The "tubular" structure of the central conductor reduces its impedance because the local increase in the current density caused by the sharp edges of the conventional strip line has been omitted.

The Finnish Patent Application No. 922101, filed at the same time with the present application, included as reference to thereto, discloses a strip line resonator in which a conductive strip has been immersed inside the plane of the dielectric substrate surface and the conductive strip itself has been produced by coating the surface of the groove produced on the substrate with a conductive material. The other surfaces of the substrate have been coated, with the exception of the surface provided with the groove, with a conductive material, acting as a ground plane. The groove extends from edge to edge of the substrate across the entire surface.

The resonator according to said Finnish patent application is composed of a rod-like piece of dielectric material, preferably ceramic material, the cross-section thereof being rectangular, as seen in the end face 3. The piece comprises an upper surface, a lower surface and the side surfaces. A groove 7 has been produced on the upper surface, extending in parallel with the longer side of the surface throughout the entire surface from the end 3 to the opposite end, dividing the upper surface into two surface parts 5 and 6. All surfaces, except the upper surface parts 5 and 6, are coated with an electrically conductive material, e.g. silver-copper blend. The surfaces may also be left uncoated, and some other conductive layer can be used around the structure, e.g. a metallic housing. Also the surface of the groove 7 has been coated in the same process. The coating of the groove is at least at one edge 8 beer connected with the coating of the end face. If the surface 3 has been coated, a narrow uncoated area 11 can be produced in the opposite end of the groove, whereby no electrically conductive connection between the coating of the groove and the coating of the end 3 exists. The coating of the groove may also be connected directly to the coating of the end face 3. The end face 3 may also be uncoated so that no distinguishing area 11 is needed. Thus, the groove 7 forms a transmission line resonator of the length of quarter-wave or half wave being dependent on whether only one end or both ends of the groove is/are connected to the coating of the end.

A grooved ceramic piece tan be made by any process known in the art, such as dry pressing, extrusion moulding or injection moulding. Also a piece of plate may be used into which a groove is cut.

A disadvantage of a strip line resonator is that the possibilities to tune the electrical properties of the resonator are quite poor due to the sandwich structure. On the other hand, the Q values thereof as well as the Q values of a coaxial resonator are good. In contrast, tuning with a microstrip structure is easy, but the quality factors, i.e. the Q values, are insufficient in some applications. It is true that in a groove resonator disclosed in said Finnish application better Q values can be obtained than in the microstrip resonator, but for certain applications a resonator with even higher Q values is required, but which should be simple to make, easy to tune, and which can be made thinner than e.g. a coaxial resonator.

SUMMARY OF THE INVENTION

This task is solved by means of a resonator structure composed of two dielectric pieces, said resonator being characterized in that on the upper surface of a first piece is provided a groove extending across the entire surface and coated with electrically conductive material, said coating being connected at least at one end to the conductive layer of the side surface, whereby the groove forms a transmission line resonator, and the upper surface of the other piece is provided with a conductive strip extending in the middle of the surface, so that said strip forms a transmission line resonator. The upper surfaces of the pieces have been placed against each other and so attached to one another that the groove and the strip are in parallel against one another.

By making the resonator structure as suggested above a resonator with high values is obtained: e.g. if the dimensions of the structure are $4\times4\times15$ mm and the resonance frequency 900 MHz, for the unloaded Q value is obtained 330 by using a ceramic material, the dielectricity constant thereof being 35. When the quality value are measured separately for each half, the value of the grooved resonator will be 285 and the value of the strip line resonator is 245. By way of comparison let it be mentioned that the quality value of a coaxial resonator with equal dimensions is 410.

BRIEF DESCRIPTION OF THE DRAWINGS

The invention will be described more in detail with reference to the accompanying drawings, in which.

DESCRIPTION OF THE PREFERRED EMBODIMENT

The resonator structure is composed of two dielectric pieces, preferably of ceramic material, of a first piece 1 provided with a groove 7, and of a second piece 2. Said first piece is shown in FIG. 1*a* and has already been described above in conjunction with the description of the Finnish Patent Application No. 922101, so that for describing FIG. 1*a* reference is here made to said description.

Figure 1A:
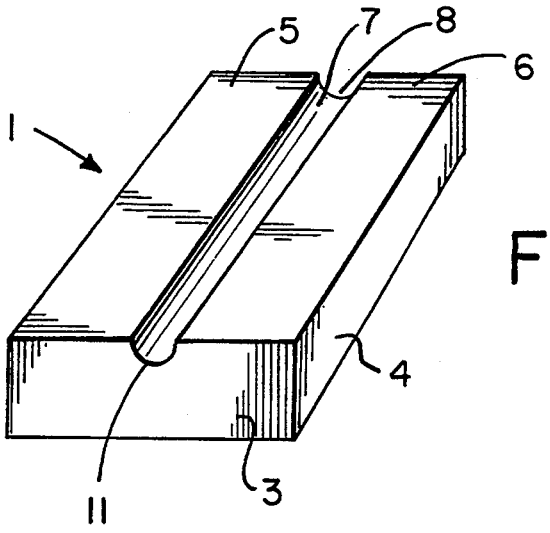
FIG. 1*a* presents in perspective a first half of a resonator provided with a groove, in accordance with both the present invention and Finnish Patent Application No. 922101.
Figure 1B:
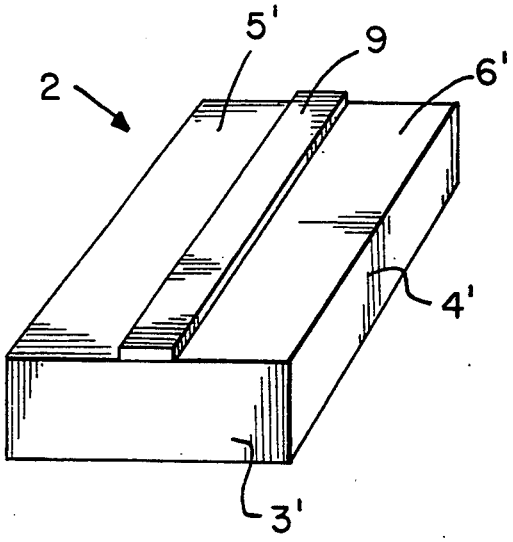
FIG. 1*b* presents in perspective the other half of the resonator provided with a strip line.

The second piece of the structure, FIG. 1*b*, is a dielectric piece, on one planar surface thereof being provided a strip line 9 extending across the surface. The shape and dimensions of piece 2 are preferably, but not necessarily, the same as in piece 1. The dielectricity constants of the pieces can be different or equal. The bottom surface of the piece 2 and at least the side surfaces, which are in parallel with the strip line 9 (surface 3 visible), and potentially one or both of the end faces (surface 3' visible), has/have been coated With a material well conducting electricity and used as a ground plane. The strip has been preferably placed so that it divides the upper surface of the piece into two equal-sized surfaces 5' and 6'. One end or both ends of the strip is/are connected to the coating of the piece, and in that manner said end is either short-circuited or open, thus constituting a quarter-wave or half-wave transmission line resonator. On the uncoated upper surface portions 5' and 6' various conductor lines and patterns can be provided with which the resonance frequency and the bandwidth of the resonator can be affected. The structure of a strip line resonator of the above type is known in the art.

Figure 2:
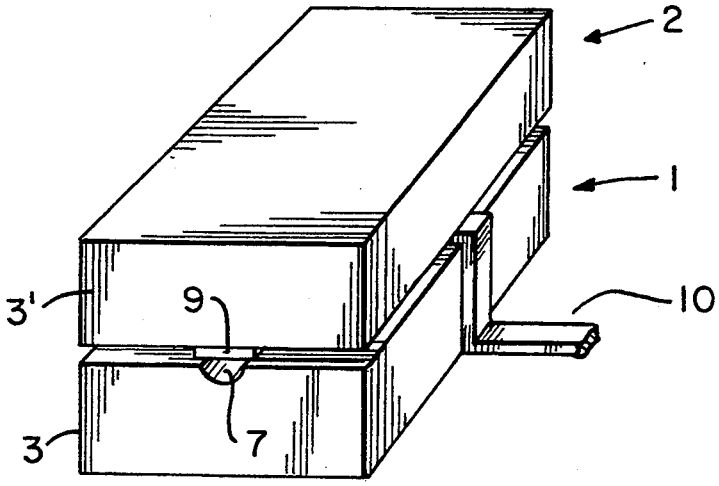
FIG. 2 shows in perspective the assembled structure.

When the resonators of FIG. 1*a* and FIG. 1*b* are connected so that the uncoated surfaces provided With the groove 8 and the strip 9 are set against each other and aligned in the same direction, the resonator structure of the invention shown in FIG. 2 is obtained. The surfaces can be placed intimately against each other, or a narrow gap may be left therebetween. Now, for instance, terminal pins can be used for separating the surfaces, one of said pins being indicated as reference with reference numeral 10. With the aid of the pins also a signal can be carried to the resonator and out therefrom. For controlling tie gap between the surfaces, a number of prior art means exist, which as such are not included within the scope of the present invention. It is also preferable in practice to fill the gap so that humidity cannot deteriorate the electrical properties in said gap. The stuffing can be implemented by filling the entire gap with an appropriate adhesive agent which also binds the pieces together, or the structure can be encapsulated totally or a bond can be used at the gap. When using encapsulation, the coating of the pieces can be omitted because the metallic encapsulation acts as a ground plane. If the pieces are desired to be insulated from one another, an insulation bond is used at the gap, which in the form of a band binds the pieces together.

As stated above various conducting patterns known in the art can be positioned on the surfaces of each piece lying against each other to be coupled to the resonator and to affect its properties. The conducting patterns are produced by means of an appropriate mask. The electrical properties can be affected greatly by selecting the resonance frequencies of the resonators shown in FIG. 1*a* and *b*. By varying these, most diverse resonators can be implemented. E.g. a strip 9 can be made short and insulated from groove 1, whereby the resonance frequency thereof can be selected to be a harmonic of the resonate frequency of the groove, whereby also harmonics can be attenuated with the same filter. Either the groove or the strip can be made switchable, so that one end thereof can be switched with a semiconductor switch placed on a uninsulated surface to the ground plane, and off therefrom. Hereby, another resonator can be switched into a half-wave resonator or quarter-wave resonator as needed. It is however preferable to form the resonance frequencies of both the strip and the groove equal in size.

Figure 3:
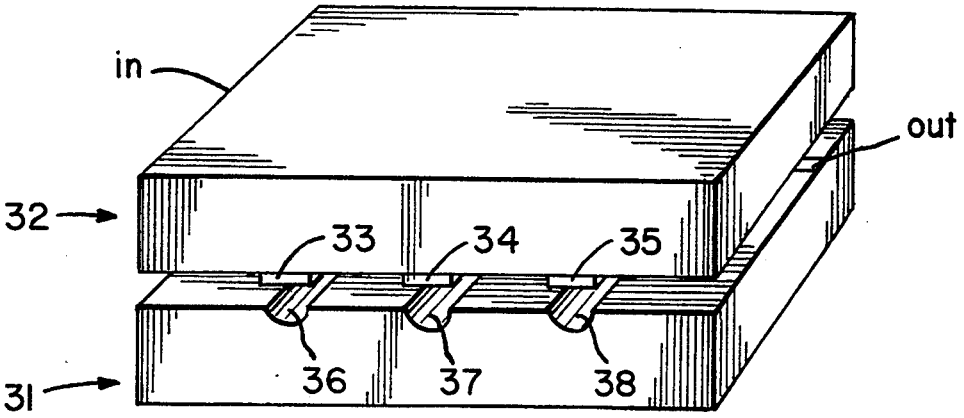
FIG. 3 is a principle perspective view of an embodiment of a filter.

FIG. 3 shows a three-circuit filter provided with resonators according to the invention. The filter consists of two dielectric pieces 31 and 32, on the surface of piece 32 being formed parallel spaced grooves 36, 37 and 38. Respectively, parallel spaced strips 33, 34 and 35 have been provided on the surface of piece 32. Conducting patterns and strips (not shown) have been arranged on the surfaces of the pieces for coupling to the resonators. The pieces are placed one against the other so that the grooves and the strips are matched together in parallel and joined with one another in the manner described above regarding an individual resonator.

Figure 4:
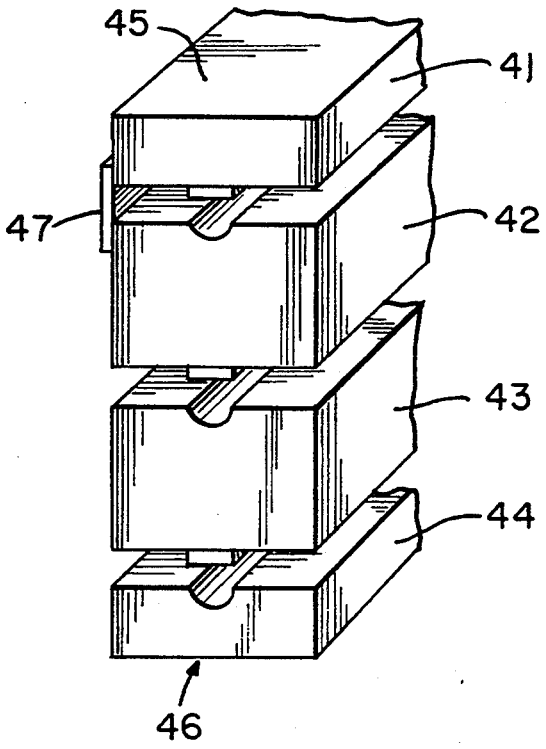
FIG. 4 presents in perspective a fragmentary view of a second embodiment of the filter.

FIG. 4 shows one more procedure for constructing a filter. A plurality of dielectric pieces have been piled one on top of the other so that a combination of a strip line resonator and a groove resonator is formed in each gap. The pieces can be placed intimately against one another, or a gap can be left therebetween, as is shown in the figure. The thickness of the most extreme pieces is half of that of the pieces in the middle. The side surfaces 41, 42, 43 and 44 and the side surfaces of each piece thereagainst (not visible in the figure) have been coated with a conductive agent. Similarly, the surfaces 45 and 46 have been coated. The end faces of the pieces can be coated in their entirety or in some parts thereof. The pieces can be joined with a band running at the gaps; as a reference only, one of said bands is designated with reference numeral 47. If the band is made of a conductive material, the side surfaces of the structure have been entirely covered with a conductive layer. Also the gaps of the end faces can be coated. Thus, such a filter is provided wherein a transmission line resonator is produced per each gap, the properties thereof being determined by the dimensions of the strip and the groove, and by the aspect of whether the strip and the groove is a quarter-wave, or half wave resonator. The resonators are coupled to each other through the dielectric material. By dimensioning the pieces, the grooves and the strips in an appropriate manner and by arranging appropriate conducting patterns on the surfaces of the gaps, a filter device can be constructed which is provided with the desired properties.

Figure 5:
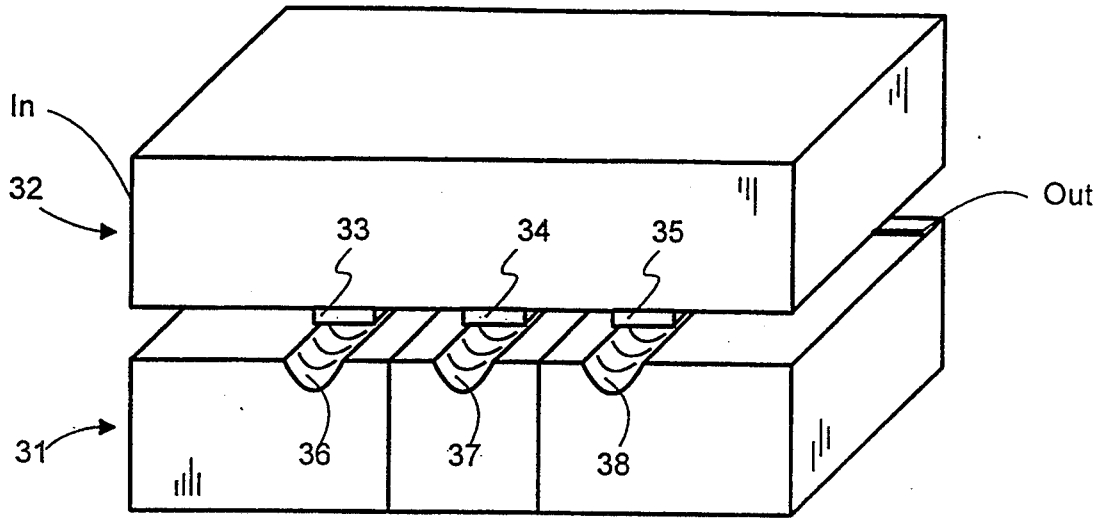
FIGS. 5 and 6 are perspective schematic representations of further embodiments of the filter.
Figure 6:
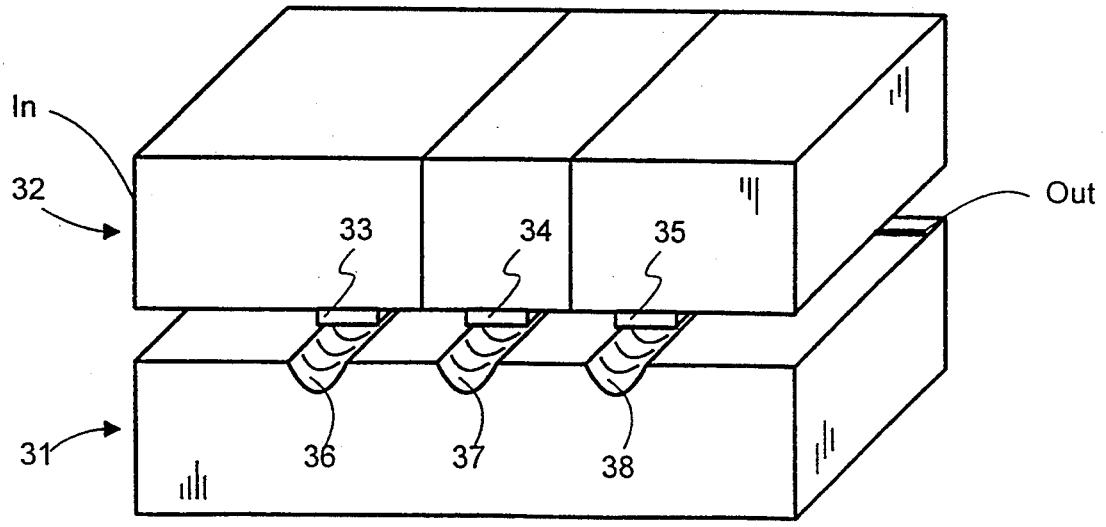

FIGS. 5 and 6 are variations on the embodiment of FIG. 3. In FIG. 5, the dielectric piece 31 of FIG. 3 is comprised of separate dielectric pieces each with a rectangular cross-section. Each of the separate dielectric pieces are provided with at least one groove 36, 37 or 38 on one of the surfaces. The separate dielectric pieces are attached to each other at the side surfaces so that the grooves are in the same plane.

In FIG. 6, the dielectric piece 32 of FIG. 3 is comprised of separate dielectric pieces each with a rectangular cross-section. Each of the separate dielectric pieces are provided with at least one conductive strip 33, 34, 35 on one of the surfaces. The separate dielectric pieces are attached to each other at the side surfaces so that the strips are in the same plane.

The resonator design and the filter according to the invention can be implemented in a number of ways, while staying within the protective scope of the claims. The connections to the resonator can be implemented in any manner known in the art. The side surfaces can be coated completely or only in part and, instead, a conductive housing can be used around the structure. The filter can be composed of two or more dielectric pieces and the dielectricity constants of the pieces may be different. Rod-like dielectric pieces with square cross-section can be used, on each side thereof being formed a groove resonator or strip line resonator. A plurality of such pieces can be placed so that their sides are lying against each other as a result of which a mosaique pattern is produced when viewed at the end, in which each space is provided with a resonator.

We claim:

1. A high-frequency filter, comprising a first and a second piece of dielectric material, said pieces being at least in part encapsulated by an electrically conductive layer serving as a ground plane, the first piece having an upper surface with a groove extending across the entire surface, said groove having an electrically conductive material coating that is confined to said groove and is connected, at least at one end, with the electrically conductive layer, whereby the coating forms a transmission line resonator, the upper surface of the second piece having a planar conductive strip extending in a middle of the surface, said strip forming a transmission line resonator, the pieces being positioned with their upper surfaces facing each other and so attached to each other that the groove and the strip are positioned in parallel and facing one another.

2. Resonator structure according to claim 1, characterized in that one end of the groove is provided with a narrow uncoated area between the coating of the groove and the electrically conductive layer of a side face of said first piece.

3. Resonator structure according to claim 1, characterized in that the coating of the groove is at both ends joined to the electrically conductive layer.

4. Resonator structure according to claim 1, characterized in that the cross-section of the groove is semicircular.

5. Resonator structure according to claim 1, characterized in that the conductive strip extends across the entire upper surface of the second dielectric piece.

6. Resonator structure according to claim 1, characterized in that the resonator of the first piece and the resonator of the second piece each have resonance frequencies which are approximately equal.

7. Resonator structure according to any one of the preceding claims, characterized in that the pieces have been so attached to each other that a gap is left between the upper surfaces.

8. A high-frequency filter, comprising a first and a second piece of dielectric material, and said pieces being at least in part encapsulated by an electrically conductive layer serving as a ground plane, the first piece having an upper surface with a plurality of grooves extending across the surface and each coated with an electrically conductive agent coating, the coating being confined to said groove and having at least one end connected to the electrically conductive layer, whereby a transmission line resonator is realized in each groove, the second piece having a planar upper surface with a plurality of spaced, parallel, planar conductive strips, each of said strips forming a transmission line resonator, and the pieces being placed with the upper surfaces thereof facing each other and so attached to each other that respective ones of the grooves are positioned in parallel and facing respective ones of the strips.

9. High-frequency filter according to claim 8, characterized in that the first dielectric piece is composed of separate pieces with rectangular cross-section, each of said pieces being provided with at least one groove on one of the surfaces, and said pieces being attached to each other at the side surfaces so that the grooves are in the same plane.

10. High-frequency filter according to claim 8, characterized in that the second dielectric piece has been composed of separate pieces with rectangular cross-section, each of said pieces being provided with at least one conductive strip on one of the surfaces and said pieces being attached to each other at the side surfaces so that the strips are in the same plane.

11. High-frequency filter, comprising a first and second edge piece made of dielectric material, and at least one dielectric centerpiece, said first edge piece having a first planar surface, said second edge piece having a second planar surface, said at least one centerpiece being positioned between the first edge piece and the second edge piece and having third and fourth planar surfaces, said first and third planar surfaces being parallel and facing each other, said second and fourth planar surfaces being parallel and facing each other, the first and fourth planar surfaces each having a groove at least in part coated with an electrically conductive material, the second and third planar surfaces each having a planar conductive strip thereon, the groove and the planar conductive strip of the first and third planar surfaces forming a combination of a groove resonator and a stripline resonator, the groove and the planar conductive strip of the second and fourth planar surfaces forming a combination of a groove resonator and a stripline resonator.

12. High-frequency filter according to claim 11, characterized in that the groove of said first planar surface extends across the entirety of the first planar surface, dividing said surface into two surface parts of equal size.

13. High-frequency filter according to claim 11, characterized in that the planar conductive strip of said second planar surface extends across the entirety of the second planar surface, dividing said surface into two surface parts of equal size.

14. High-frequency filter according to any one of claims 11–13, characterized in that the pieces have been so attached to each other that a gap exists between the opposite planar surfaces therebetween.

15. High-frequency filter according to claim 1, wherein said upper surface of the second piece is planar.

16. High-frequency filter according to claim 11, wherein said at least one centerpiece includes a first centerpiece having said third planar surface and includes a second centerpiece having said fourth planar surface.

* * * * *